US005992424A

United States Patent [19]

Repsha et al.

[11] Patent Number: 5,992,424

[45] Date of Patent: Nov. 30, 1999

[54] HAIRPIECE AND METHOD OF ATTACHING HAIRPIECE TO USER'S HEAD

[75] Inventors: Francis J Repsha, Monmouth Jct.; Estanislav R Ruiz, Winfield, both of N.J.

[73] Assignee: Flash For Hair Perth Amboy, Inc, East Brunswick, N.J.

[21] Appl. No.: 09/285,823

[22] Filed: Apr. 2, 1999

[51] Int. Cl.[6] ..... A41G 5/00

[52] U.S. Cl. ..... 132/201; 132/53; 132/200; 132/54

[58] Field of Search ..... 132/53, 54, 55, 132/56, 200, 201

[56] References Cited

U.S. PATENT DOCUMENTS

| | | | |
|---|---|---|---|
| 513,579 | 1/1894 | Kinzly . | |
| 851,384 | 4/1907 | Sleicher . | |
| 3,421,521 | 1/1969 | Rich . | |
| 3,710,452 | 1/1973 | Hamrick . | |
| 3,777,768 | 12/1973 | Scigliano | 132/201 |
| 3,970,092 | 7/1976 | Nelson . | |
| 4,296,765 | 10/1981 | Bachtell . | |
| 4,456,019 | 6/1984 | Finamore . | |
| 4,964,428 | 10/1990 | Lamatrice . | |
| 5,033,486 | 7/1991 | Finamore . | |
| 5,117,846 | 6/1992 | Finamore et al. | 132/53 |
| 5,218,977 | 6/1993 | Takahashi | 132/53 |
| 5,313,963 | 5/1994 | Rennex . | |
| 5,368,052 | 11/1994 | Finamore | 132/53 |
| 5,575,298 | 11/1996 | Hinton . | |
| 5,746,232 | 5/1998 | Martin . | |
| 5,853,009 | 12/1998 | Yu | 132/54 |
| 5,855,211 | 1/1999 | Nelson | 132/53 |

*Primary Examiner*—Jeffrey A. Smith
*Assistant Examiner*—Pedro Philogene
*Attorney, Agent, or Firm*—Daniel Kirshner

[57] ABSTRACT

A hair replacement device which includes a hair attachment flap hingedly attached to the interior of the base and along its perimeter. A plurality of perforations are formed into the hair attachment flap where the preferred perforations are slits which may be shaped like arrow heads. A method of attaching a hair replacement device to a wearer's head is disclosed whereby the wearer's own natural hair is pulled through the perforations on the hair attachment flap and secured using adhesive.

12 Claims, 3 Drawing Sheets

HAIRPIECE AND METHOD OF ATTACHING HAIRPIECE TO USER'S HEAD

FIELD OF THE INVENTION

The present invention relates to hairpieces and a method of attaching hairpieces to the user's head. More specifically, a slitted hair-attachment flap is secured to the base of the hairpiece and the user's existing hair is pulled through the slits thereby attaching the hairpiece.

BACKGROUND OF THE INVENTION

Hair loss is a problem which affects many people. While some people affected by hair loss simply accept the resulting change in appearance, others do not and seek devices and methods to replace their lost hair. Over the years, many prior art devices and methods have been devised to help those individuals who wished to maintain the appearance of a full head of hair.

Throughout the worldwide industry of hair replacement and the history thereof, artisans in the practice of non-surgical hair replacement as well as the manufacturers of various types of hair pieces have traditionally strived for better methods of hair attachment. Any method or procedure to be considered would have to address two primary concerns as they relate to the prospective client.

First would be the appearance. The particular method or procedure chosen should enhance the appearance of the user and at least have no negative impact on the aesthetic and realistic qualities of the chosen hairpiece. Second, but no less important is the method of attachment. The method or procedure should improve upon or at least have no negative impact on the level of security and comfort the hair piece attachment method affords.

Traditionally, prior art hair replacement or hair piece attachment procedures have been divided into two categories. There are those referred to as "semi-permanent", such as mechanical clips or double-sided tape. These methods offer the hair replacement wearer the freedom and flexibility to remove the hair piece at will, while providing a reasonable security of attachment in the wind, while swimming, etc.

For other hair replacement clients, only a permanent attachment will do. While there is actually nothing permanent about a permanent attachment, these methods offer the user a higher level of security, as well as a method of attachment that more closely replicates their original hair growth. These methods require a routine maintenance about every four to eight weeks. The most common of the permanent attachment methods are the bond method, the weave method, and what is sometimes referred to as a point attachment.

The bond method, probably the most popular of all the permanent attachment methods, employs any one of a number of medical-grade adhesives and offers the client a reasonable level of security, a low level of detectability, and a reasonable degree of comfort at the time of attachment. Many clients, however, endure a number of drawbacks with this method. Although the mastic used is a medical grade adhesive, prior art methods require the adhesive to be placed directly in contact with the scalp. Many clients suffer an allergic reaction to the mastic, and others complain of a reaction to the bond or the combination of the bond and a tape. This process also requires the user's own hair to be shaved at the point of attachment.

The weave method is actually one of any number of different braiding techniques. While most weave methods offer a relatively high level of security, they vary in diameter and are therefore more difficult to conceal. Also, there is usually a certain level of discomfort that the user must tolerate.

The point attachment method is usually employed by hair replacement specialists who do not weave hair, and are used on a client who can not be bonded. This method, actually can be any number of knotting techniques, and may or may not employ a bonding mastic as well. This method usually offers the least amount of comfort and security and usually has the shortest longevity.

Several prior art patents have disclosed devices and methods to address the deficiencies in the art. For example, U.S. Pat. No. 3,970,092 entitled Method of Attaching a Hairpiece was issued to Nelson on Jul. 20, 1976. This patent disclosed a method of attaching a hairpiece wherein the recipient's natural hair is utilized to "lock" the hairpiece in place. After the hairpiece, which has a base element comprising open-hole netting, has been positioned on the recipient's head, the natural hair underlying the base element is pulled up and through the base. Thereafter, a selected plurality of hair lengths are divided into pairs of groups which are knotted together. Once the knot has been tied, a drop of adhesive is applied to the knot to prevent it from coming loose. This prior art method presents several drawbacks as compared to the invention disclosed herein. First, like most weaving methods, a certain amount of strain is placed on the hair through the knotting, thereby presenting a degree of discomfort to the recipient. Second, this method utilizes an adhesive which may come into contact with the recipient's scalp thereby causing an allergic or non-allergic reaction.

Another prior art method is presented in U.S. Pat. No. 5,033,486 entitled Method for Attaching a Hairpiece to the Scalp which was issued to Finamore, et al. on Jul. 23, 1991. This method comprises removing a strip of natural hair from the recipient along a band below the wearer's natural hair line. Next, an adhesive material is applied along the scalp band in order to affix the hairpiece to the user. As is evident, this prior art method has several disadvantages when compared to the invention disclosed herein. First, it is necessary to remove a band of the wearer's natural hair. Second, as in other bonding methods, the adhesive is applied directly to the wearer's scalp, giving rise to the possibility of reaction or allergy.

Yet a third prior art patent discloses a method of attaching a hairpiece. U.S. Pat. No. 4,296,765 entitled Method and Apparatus for Securing a Hairpiece was issued to Bachtell on Oct. 27, 1981. Here, the hairpiece has a plurality of loops. At each of the plurality of loops, a first adjacent group of natural hair is pulled through the loop and held outwardly extended from the wearer's head under tension. A second adjacent group of natural hair is then pulled through and held under tension so that the two groups of hair cross against each other. A line is then tied about the two groups where they cross and a liquid adhesive is applied to the line. Again, when compared to the invention disclosed herein, the disadvantages of tension on the wearer's natural hair and the application of adhesive are presented.

It is therefore an objective of the present invention to provide a hair replacement device and a method of attaching it to the wearer's head that overcomes the deficiencies of the prior art.

It is further an objective of the present invention to provide a hair replacement device and a method of attaching it to the wearer's head that does not utilize a weaving method.

It is further an objective of the present invention to provide a hair replacement device and a method of attaching it to the wearer's head that does not require an adhesive to make contact with the skin of the wearer's scalp.

It is further an objective of the present invention to provide a hair replacement device and a method of attaching it to the wearer's head that does not require the wearer's natural hair to be shaved prior to installation.

It is further an objective of the present invention to provide a hair replacement device and a method of attaching it to the wearer's head that does not cause stress or tension to the wearer's natural hair.

Other objectives, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

The present invention is a hair replacement device and method of attaching a hair replacement device to the wearer's head. The hair replacement device comprises a base, which can be either a stock device or custom fabricated to the wearer's scalp from a template, and a slitted hair-attachment strip. The hair-attachment strip is attached to the base on the interior surface of the base and along its perimeter. The attachment is made along the edge closer to the center of the base, and not at the edge closer to the perimeter of the base. Thus the hair attachment flap is hinged. A plurality of slits are formed into the hair-attachment strip and in one preferred embodiment, the slits are shaped like arrowheads.

A method of attaching the hair replacement device of the present invention to the wearer's scalp is also disclosed. A strip of double-faced adhesive tape is applied to the interior surface of the base along its perimeter. A second piece of double-faced adhesive tape is applied to the surface of the hair-attachment flap that faces the base. The hair replacement device is fitted to the scalp of the user and positioned properly. The base is clipped using hair clips to expose the hair-attachment flap. Next, the backing is removed from the strip of adhesive that is affixed to the hair-attachment flap. A hooked tool is utilized to pull the wearer's natural hair through the slits and the hair is pressed into the double-faced adhesive tape on the hair-attachment flap in order to secure. Now, the backing is removed from the strip of adhesive tape that is affixed to the base. Finally, the hair-attachment flap and the base are pressed together to secure the hair-replacement device to the wearer's head.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
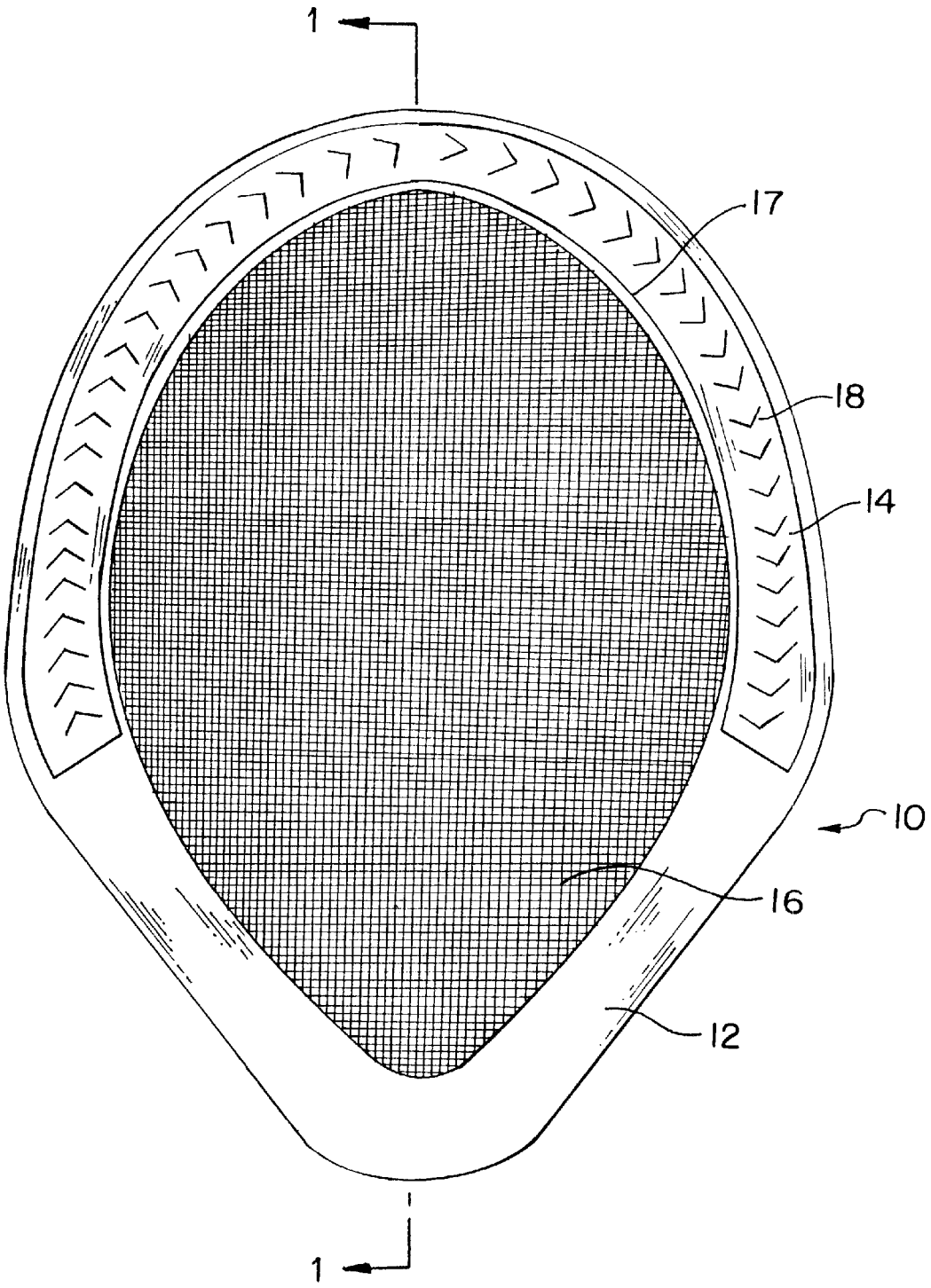
FIG. 1 is a top perspective view of the bottom or interior surface of the hair replacement device of the present invention.

Referring to FIG. 1, the present invention is a hair replacement device 10 comprising a base 12 and a slitted hair-attachment flap 14. The base 12 of the present invention is similar to well known bases of prior art hair replacement devices in which the base is able to accept double-faced adhesive tape. The base 12 may be a stock, off-the-shelve, prior art base which are available in a variety of sizes. Alternatively, the base may be custom manufactured from a template so that the base conforms to the contours of the wearer's scalp. Whether the base is stock or custom manufactured, it has a curvature to match the curvature of the human head as closely as possible. Typically, bases are manufactured from a polymer, latex or cotton, although another material could be used so long as it will adhere to double-faced adhesive tape.

The base includes a fine mono-filament mesh center portion 16 as is well known the prior art. Human or artificial hair (not shown in the drawing) is attached to the fine mono-filament center portion in a variety of methods where the most common method is knotting the hair.

Figure 2:
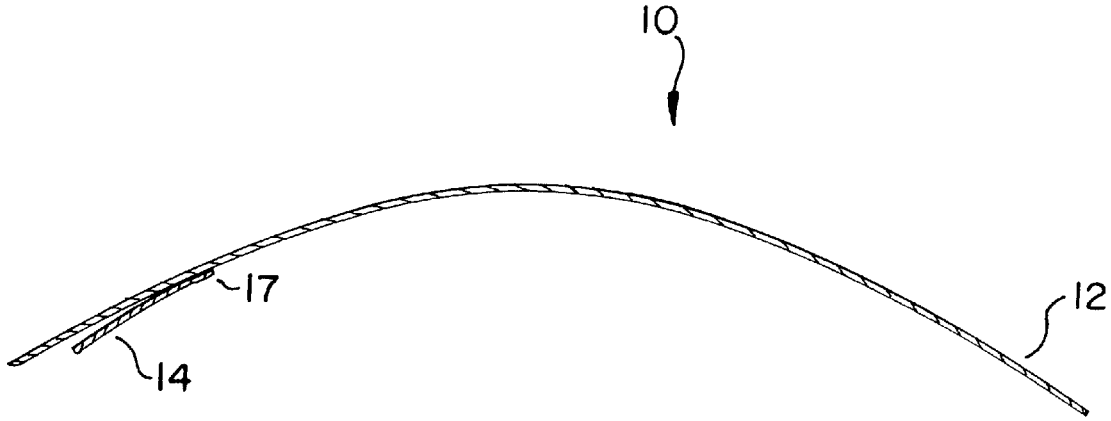
FIG. 2 is a cross-sectional view of the hair replacement device of the present invention viewed along line 1—1 of FIG. 1.

Still referring to FIG. 1, the hair replacement device of the present invention includes a hair-attachment flap 14. The hair-attachment flap is formed from polymer, latex, cotton or another material which adheres to double-faced tape. The hair-attachment flap 14 is attached to the base 12 along the perimeter of the hair replacement device 10 on interior surface of the base (the surface that contacts the wearer's scalp). Referring to FIG. 2, the hair-attachment flap 14 is attached to the base 12 along the edge of the hair-attachment flap closer to the center of the base 12 where the attachment point is designated 15. The hair-attachment flap 14 is not attached along its edge closer to the perimeter of the base 12 thus the hair-attachment flap 14 is hinged. The hair-attachment flap 14 is attached to the base using any of a variety of methods including welding, ultrasound, gluing, fusing or sewing. Depending on the degree of hair loss of the wearer, the hair-attachment flap 14 may extend all the way around the perimeter of the base, or only part of the way around. The hair-attachment flap 14 can either be formed from one piece or several sections. In the case of a hair-attachment flap 14 formed from sections, the sections should overlap in order to better prevent the exposure to moisture.

Referring back to FIG. 1, a plurality of perforations 18 are formed into the hair-attachment flap 14. In one preferred embodiment of the present invention hair replacement device, the perforations 18 are formed in the shape of slits into the hair-attachment flap 14 where the perforations 18 are disposed diagonally into the hair-attachment flap 14. In another preferred embodiment of the present invention as shown in FIG. 1, the perforations are shaped like arrowheads which point along the longitudinal axis of the hair-attachment flap 14 and point along the direction of growth of the wearer's natural hair.

Figure 3:
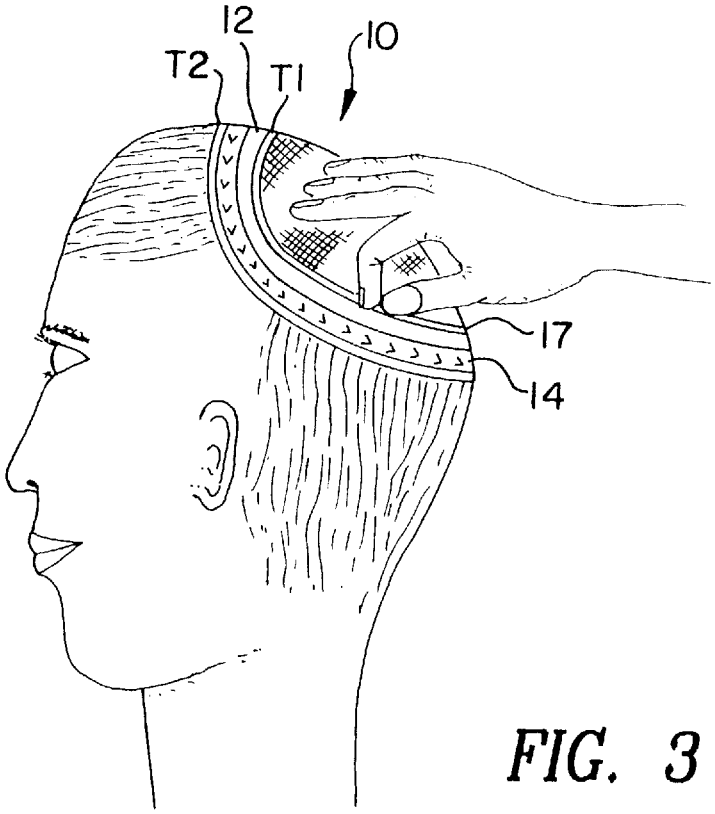
FIG. 3 is perspective view of the head of the hair replacement device's wearer, exposing the hair-attachment flap of the present invention.
Figure 4:
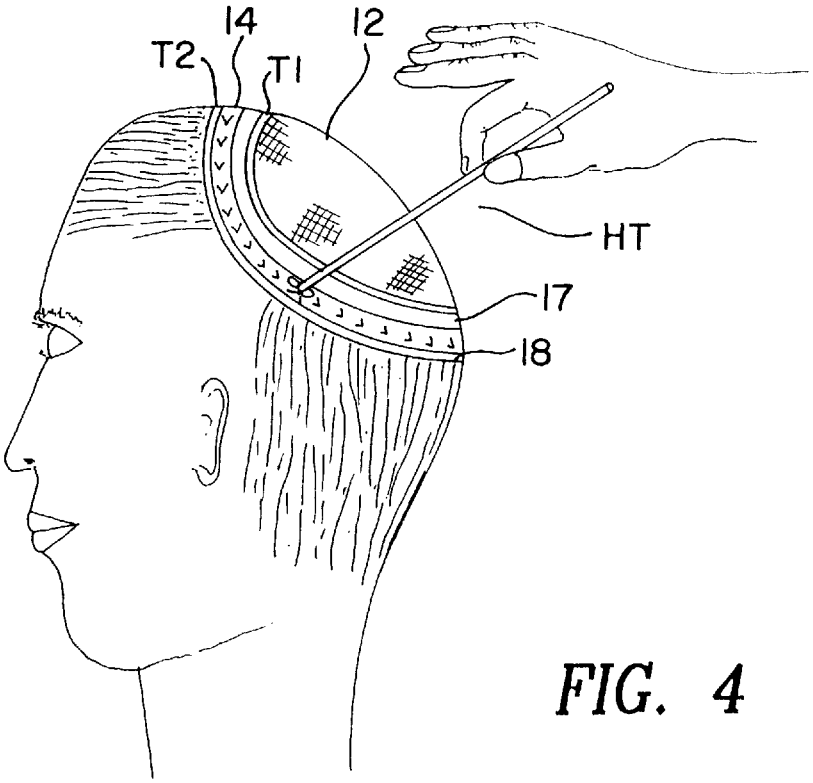
FIG. 4 is perspective view of the head of the hair replacement device's wearer, showing the wearer's natural hair being pulled through a slit using a hooked tool.

Now, referring to FIG. 3, the hair replacement device 10 of the present invention is attached to the head of the wearing by utilizing the following method. An adhesive material such as a strip of double-faced adhesive tape (designated T1) is applied to the interior surface of the base 12 along its perimeter. Typically, the width of the strip of double-faced adhesive tape is in the range of ½ inch to ¾ inch. A second piece of double-faced adhesive tape (designated T2) or other adhesive is applied to the surface of the hair-attachment flap 14 that faces the base 12. Typically, the width of this second piece of double-faced adhesive tape is narrower than the first piece. It has been determined that the best results are obtained when the double-faced adhesive tape is cloth tape but other types of double-faced adhesive tape or mastic can be used. The hair replacement device 10 is fitted to the scalp of the user and positioned properly. The perimeter portion 17 of the base is pulled up and away from the scalp and the base is clipped using hair clips to expose the hair-attachment flap 14. Next, the backing is removed from the strip of adhesive T2 that is affixed to the hair-attachment flap 14. As depicted in FIG. 4, a hooked tool (labeled as HT) similar to a crocheting needle is utilized to pull the wearer's natural hair through the perforations 18 and the hair pressed into the double-faced adhesive tape T2 on the hair-attachment flap 14 in order to secure. Now, the backing is removed from the strip of adhesive tape T1 that is affixed to the perimeter portion 17 of the base. Finally, the hair-attachment flap 14 and the perimeter portion 17 of the base are pressed together so that the adhesives T1 and T2 secure the hair-replacement device 10 to the wearer's head. As is evident, the hair replacement device is secured to the user's head without the need to apply adhesive directly to the scalp.

What is claimed is:

1. A hair replacement device comprising:

a. a base having an interior surface, b. a hair-attachment flap hingedly attached to the interior surface of said base, c. and, at least one perforation through said hair-attachment flap, whereby a wearer's own natural hair is pulled through said at least one perforation through said hair-attachment flap in order to secure the hair replacement device to the wearer's head.

2. The hair attachment device of claim 1 wherein said hair-attachment flap is attached along the perimeter of said interior surface of said base.

3. The hair attachment device of claim 1 wherein said at least one perforation is a slit.

4. The hair attachment device of claim 3 wherein said slit is position diagonally on said hair attachment flap.

5. The hair attachment device of claim 3 wherein said slit is formed in the shape of an arrowhead.

6. A method of attaching a hair replacement device to the head of a wearer comprising the steps of:

a. positioning the hair replacement device on the head of the wearer, and b. pulling the natural hair of the wearer through perforations on a hair-attachment flap.

7. The method of attaching a hair replacement device to the head of a user of claim 6 further comprising the steps of:

a. affixing an adhesive substance to a surface of said hair-attachment flap, wherein said surface faces a base of said hair replacement device, thereby affixing said hair replacement device to the head of the wearer.

8. The method of claim 7 wherein said adhesive substance is double-faced adhesive tape.

9. The method of claim 7 which further includes the step of applying an adhesive substance to an interior surface of said base portion of said hair replacement device, wherein said interior surface faces the head of the user.

10. The method of claim 9 wherein said adhesive substance is double-faced adhesive tape.

11. The method of claim 6 where the user's natural hair is pulled through the hair attachment flap utilizing a hooked tool.

12. A hair replacement device which includes a perforated hair attachment flap whereby a wearer's natural hair is pulled through said perforated hair attachment flap thereby securing the hair replacement device to the wearer's head.

* * * * *